US005403205A

United States Patent [19]

Hashiguchi

[11] Patent Number: 5,403,205

[45] Date of Patent: Apr. 4, 1995

[54] CONNECTOR COVERED WITH CONDUCTIVE FRONT AND BACK SHELLS AND COMPRISING A RESILIENT CONDUCTIVE MEMBER BETWEEN THE SHELLS

[75] Inventor: Osamu Hashiguchi, Tokyo, Japan

[73] Assignee: Japan Aviation Electronics Industry, Inc., Japan

[21] Appl. No.: 253,418

[22] Filed: Jun. 3, 1994

Related U.S. Application Data

[62] Division of Ser. No. 107,966, Aug. 16, 1993, Pat. No. 5,364,291.

[30] Foreign Application Priority Data

Sep. 28, 1992 [JP] Japan ..... 4-67308 U
Sep. 29, 1992 [JP] Japan ..... 4-67729 U
Sep. 30, 1992 [JP] Japan ..... 4-68245 U

[51] Int. Cl.[6] ..... H01R 13/648

[52] U.S. Cl. ..... 439/607; 439/733; 439/746

[58] Field of Search ..... 439/607-610, 439/88, 78, 733, 744, 746, 869, 873

[56] References Cited

U.S. PATENT DOCUMENTS 4,834,678 5/1989 Emadi et al. ..... 439/744 X
5,046,967 9/1991 Majernik et al. ..... 439/610
5,052,949 10/1991 Lopata et al. ..... 439/610
5,059,140 10/1991 Philippson et al. ..... 439/610 X
5,158,479 10/1992 Mouissie ..... 439/733 X

*Primary Examiner*—Khiem Nguyen
*Attorney, Agent, or Firm*—Laff, Whitesel, Conte & Saret, Ltd.

[57] ABSTRACT

In a connector which comprises an insulator body and conductive contacts fixedly held by the insulator body and is covered with a front shell protecting the conductive contacts and a pair of back shells brought into mechanical contact primarily with the insulator body and into electric contact with each other and with the front shell, a resilient conductive member is backwardly extended from the front shell and is resiliently deformed into mechanical contact with one of the back shells to thereby reinforce the electric contact in order to reliably cope with electromagnetic interference between the connector and its surroundings. Such a member may be extended forwardly from one of the back shells. Alternatively, such members may be extended from the front shell and/or the back shells. Preferably, holding holes are formed through the insulator body with each conductive contact made to comprise a contact stem which has a planar surface and is for force fit in the holding hole for the conductive contact under consideration. In such an event, a guide way is extended from each holding hole. A contact leg is extended backwardly from the contact stem and is curved relative to the planar surface to fill the guide way. Alternatively, an insulator cover is used to bring each conductive wire of a cable into press fit in a bifurcated conductive end and of the conductive contact for the conductive wire in question.

3 Claims, 9 Drawing Sheets

CONNECTOR COVERED WITH CONDUCTIVE FRONT AND BACK SHELLS AND COMPRISING A RESILIENT CONDUCTIVE MEMBER BETWEEN THE SHELLS

This application is a division of prior application Ser. No. 08/107,966, filed Sep. 16, 1993, now U.S. Pat. No. 5,364,291.

BACKGROUND OF THE INVENTION

This invention relates to a connector connected to an electric cable and covered with a conductive housing or casing in order to avoid electromagnetic interference (EMI) with its surroundings.

In the manner which will later be described more in detail, a connector comprises an insulator body or block and a plurality of conductive contacts extended forwardly from the insulator body. Typically, the conductive contacts are firmly held by the insulator body and connected to conductive wires of a cable which extends backwardly from the insulator body.

When used to cover the insulator body and the conductive contacts, a conductive housing comprises a metal front shell having primarily a pair of parallel opposing portions to protect the conductive contacts and first and second back shells put in electric contact with each other and having primarily first and second inside surfaces in mechanical contact with the insulator body and in electric contact with the opposing portions. In a conventional connector of the type described, the electric contact between the opposing portions and the first and the second inside surfaces is often insufficient and unreliable.

The conductive contacts are usually brought into force fit into a plurality of holding holes formed through the insulator body to open at its front and back surfaces. More particularly, each conductive contact comprises a contact stem having a planar surface and for force fit in a corresponding one of the holding holes, a contact end extended from the contact stem for forward projection from the insulator body and curved relative to the planar surface, and a contact leg extended from the contact stem opposite to the contact stem for connection to a corresponding one of the conductive wires. In order to make it possible to force such a conductive contact into the insulator body from the back surface, a guide way is added to each holding hole to enable pass therethrough of the contact end. Such guide ways are left open at the back surface. The conductive housing is generally covered with a hood of an insulator material.

In a conventional connector of this type, the insulator material flows into the guide ways to deteriorate electric contact between the contact stems and the conductive wires. Potting has consequently been mandatory so as to prevent the insulator material from flowing into the guide ways. Potting is, however, troublesome, raises the cost of manufacture of such connectors, and gives rise to fluctuations in quality of the connectors.

A connector often comprises the conductive contacts of the type described in one-to-one correspondence to the conductive wires of a cable with each conductive contact made to comprise a bifurcated conductive end in place of the contact leg. More specifically, the bifurcated conductive end is extended perpendicularly of the planar surface of the contact stem. The conductive wires are brought into press fit in the bifurcated conductive ends of corresponding ones of the conductive contacts. In such an event, first and second cover components of an insulator cover are provided with a plurality of protrusions to hold the conductive wires in correspondence to the bifurcated conductive ends.

On assembling such a connector, the first and the second cover components are pressed against each other with the bifurcated conductive ends interposed. An appreciable length of each conductive wire is exposed to surroundings. When used, the conductive housing may be undesirably brought into electric contact with the conductive wires of such an appreciable length. It has therefore been practice to interpose an insulator sheet between the conductive wires and the conductive housing. This objectionably renders the connector thick.

SUMMARY OF THE INVENTION

It is consequently a principal object of the present invention to provide a connector covered with a front shell and a pair of back shells, in which the first shell and the back shells are reliably electrically connected together.

It is a subordinate object of this invention to provide a connector, wherein each conductive contact completely fills an opening which is formed through an insulator body for firmly holding such conductive contacts.

It is another subordinate object of this invention to provide a connector of a thin thickness.

It is another principal object of this invention to provide a connector which is of the type described above.

Other objects of this invention will become clear as the description proceeds.

On setting forth the gist of an aspect of this invention, it is possible to understand that a connector is covered with a conductive housing and comprises an insulator body and a plurality of conductive contacts extended forwardly from the insulator body. The conductive housing comprises a front shell having a pair of opposing portions to protect the conductive contacts and first and second back shells put in electric contact with each other and having first and second inside surfaces in mechanical contact with the insulator body and in electric contact with the opposing portions.

In accordance with the aspect being described, the front shell of the above-understood connector comprises a resilient conductive member backwardly extended from a predetermined one of the opposing portions and resiliently deformed into mechanical contact with one of the first and the second inside surfaces that is in electric contact with the predetermined one of the opposing portions, whereby the resilient conductive member reinforces the electric contact between the opposing portions and the above-mentioned one of the first and the second inside surfaces.

In accordance with a different aspect of this invention, a predetermined one of the first and the second back shells of the above-understood connector comprises a resilient conductive member forwardly extended from one of the first and the second inside surfaces that the predetermined one of the first and the second back shells has. The resilient conductive member is resiliently deformed into mechanical contact with the opposing portions to reinforce the electric contact between the opposing portions and the above-mentioned one of the first and the second inside surfaces.

On setting forth the gist of a further different aspect of this invention, it is possible to understand that a connector comprises an insulator body having a connector axis and a plurality of conductive contacts extended parallel to the connector axis and forwardly from the insulator body. In the connector taken into consideration, the insulator body has main walls defining a plurality of holding holes parallel to the connector axis and in one-to-one correspondence to the conductive contacts, and a wall extension extended from each of the main walls to define a guide way. For this connector, each of the conductive contacts comprises a contact stem having a planar surface and for force fit in a corresponding one of the holding holes, a contact end extended from the contact stem and curved relative to the planar surface to pass through the guide way, and a contact leg extended from the contact stem opposite to the contact end.

In accordance with the further different aspect of this invention, the contact leg of the above-understood connector is curved relative to the planar surface of the contact stem to fill the guide way when the contact stem is brought into force fit in the corresponding one of the holding holes with the contact end protruded forwardly from the insulator body.

On setting forth the gist of a still further different aspect of this invention, it is possible to understand that a connector comprises an insulator body having a connector axis and a plurality of conductive contacts extended parallel to the connector axis and forwardly from the insulator body. In the connector being taken into consideration, the insulator body has a back surface perpendicular to the connector axis and main walls defining a plurality of holding holes parallel to the connector axis and in one-to-one correspondence to the conductive contacts. In this connector, each of the conductive contacts comprises a contact stem for force fit to a corresponding one of the holding holes, a contact end extended from the contact stem, and a bifurcated conductive end extended from the contact stem opposite to the contact end. This connector further comprises an insulator piece holding, in one-to-one correspondence to the conductive contacts, insulator covers clothing conductive wires, respectively.

In accordance with the last-mentioned aspect of this invention, the insulator body of the above-understood connector further has wall extensions extended backwardly from the main walls to define guide holes open to the back surface. The bifurcated conductive end is directed parallel to the contact stem and situated in a corresponding one of the guide holes with the contact end protruded forwardly from the insulator body. The insulator piece is forced to the back surface to bring a corresponding one of the conductive wires into press fit in the bifurcated conductive end with the corresponding one of the conductive wires placed in the corresponding one of the guide holes substantially perpendicular to the bifurcated conductive end. In addition, the insulator piece has an insulator extension for covering free ends of the conductive wires.

It is possible in accordance with this invention to provide a connector according to whichever of the different aspects of this invention either singly or in combination with the connector according to the first-described aspect of this invention.

DESCRIPTION OF THE PREFERRED EMBODIMENTS

Figure 1:
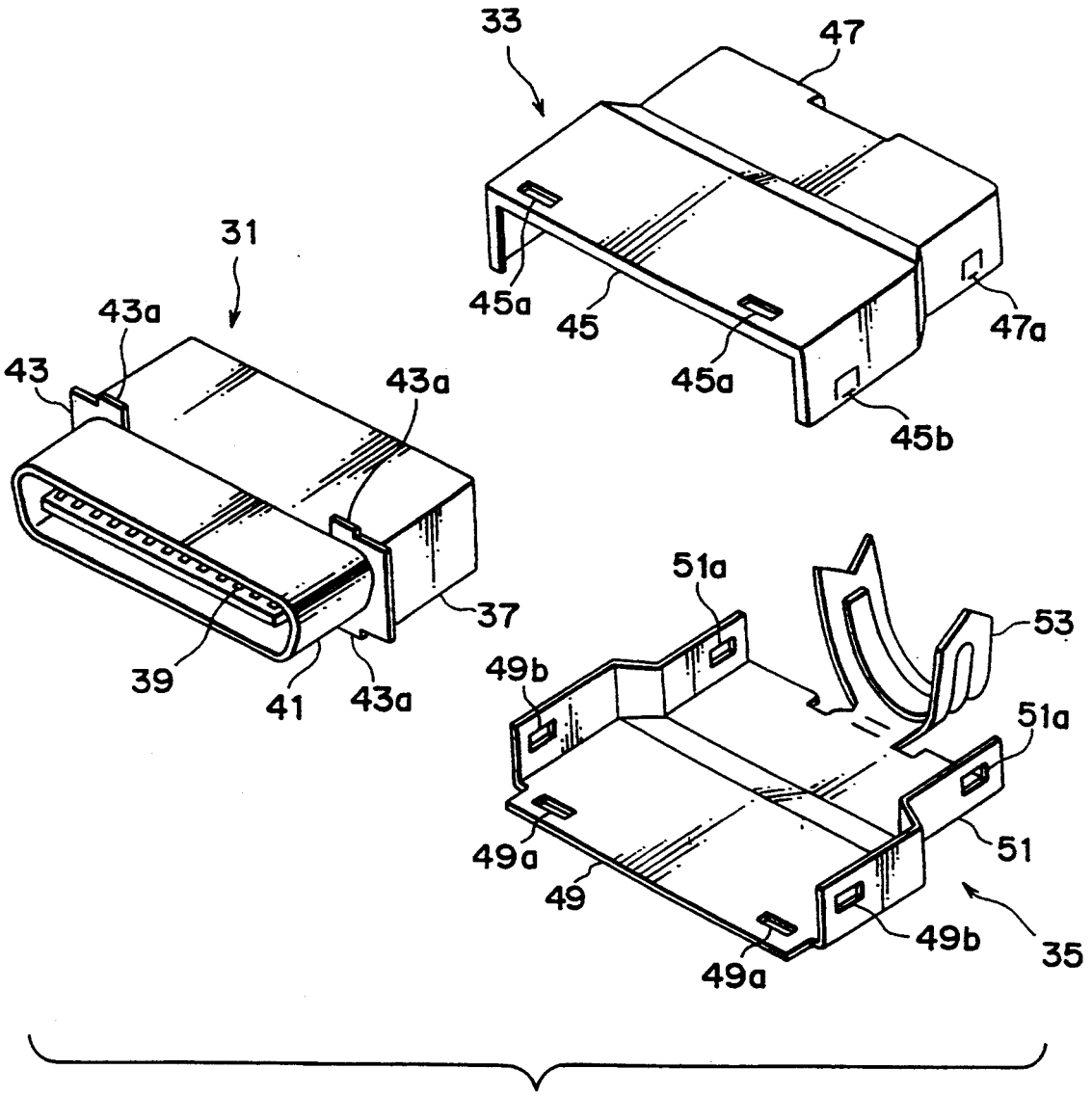
FIG. 1 PRIOR ART
FIG. 1 is an exploded schematic perspective view of a conventional connector.
Figure 2:
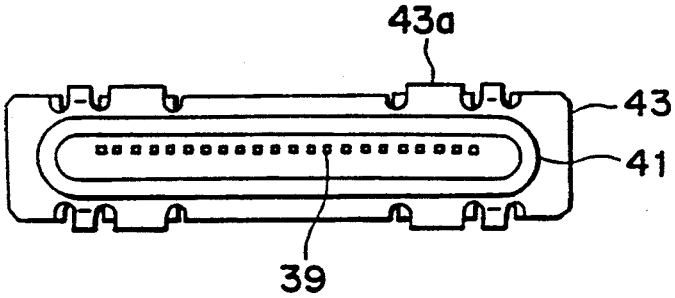
FIG. 2 is a schematic front view of a connector according to a first embodiment of the instant invention.
Figure 3:
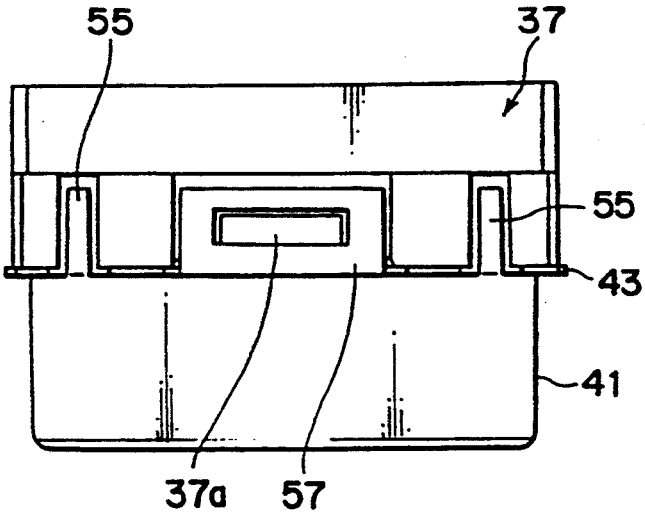
FIG. 3 is a schematic top view of the connector illustrated in FIG. 2.
Figure 5:
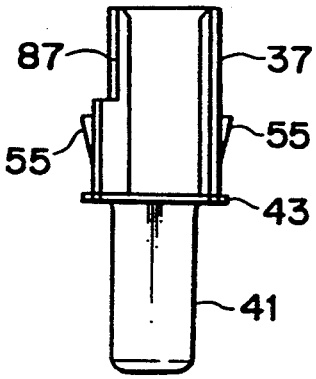
FIG. 5 is a schematic right side view of the connector shown in FIG. 2.
Figure 4:
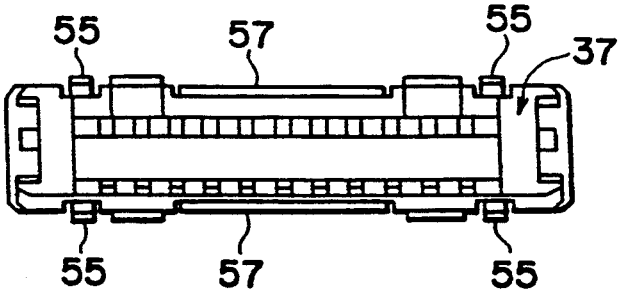
FIG. 4 is a schematic back view of the connector depicted in FIG. 2.

Referring to FIG. 1, a conventional connector will first be described in order to facilitate an understanding of the present invention. It will be presumed without loss of generality that such a connector is a male connector. In the manner known in the art, the male connector is detachably connected to a female connector (not shown).

The conventional connector comprises a connector body 31. In the manner which will become clear as the description proceeds, an upper back shell 33 and a lower back shell 35 enclose the connector body 31.

The connector body 31 comprises an insulator body 37 of a substantially rectangular parallelopiped shape having a front and a back surface and a connector axis enclosed with an upper and a lower side surface and a right and a left side surface. A plurality of conductive contacts 39 extend from the front surface of the insulator body 37 forwardly along the connector axis.

A front shell 41 comprises a cylindrical portion which is of a flat elliptic shape in cross-section, has a back edge in contact with the front surface, and encircles the conductive contacts 39 to protect the contacts 39. Each of the back shells 33 and 35 and the front shell 41 is made of metal. A combination of the first shell 41 and the upper and the lower back shells 33 and 35 serves as a conductive housing for the connector body 31 and the conductive contacts 33. A connector with such a conductive housing is called a connector with shells in the art.

In the front shell 41, a metal flange 43 extends outwardly of the cylindrical portion perpendicularly of the connector axis. The flange 43 is brought into contact with the front surface of the insulator body 37. Four flange projections 43*a* extend from the flange 43 perpendicularly of the cylindrical portion. As will presently be described, the flange projections 43*a* are for use in fixedly attaching the upper and the lower back shells 33 and 35 to the connector body 31.

The upper back shell 33 is generally U-shaped in cross-section and consists of an upper front portion 45 and an upper back portion 47. Generally speaking, the upper front portion 45 is for half-way covering the insulator body 37. The upper back portion 47 is extended from the upper front portion 45 stepwise to receive an upper half of the back surface of the insulator body 31.

More particularly, the upper front portion 45 extends slightly forwardly of the front surface of the insulator body 37 when put in place. The upper front portion 45 comprises an upper front face portion brought into contact with the upper side surface. Two upper rectangular holes 45*a* are formed through the upper front face portion in order to correctly position the upper back shell 33 relative to the connector body 31. That is, the rectangular holes 45*a* are for snugly receiving two of the flange projections 43*a*. Upper front side portions extend from the upper front face portion. A front projection 45*b* is projected slightly inwardly of each of the upper front side portions.

Like the upper front portion 45, the upper back portion 47 comprises an upper back face portion and a pair of upper back side portions. Two back projections 47*a* project from the upper back side portions.

The lower back shell 35 is also generally U-shaped in cross-section and comprises a lower front portion 49 and a lower back portion 51. Broadly speaking, the lower front portion 49 is for half-way receiving the insulator body 37 and is tightly received in the upper front portion 45. The lower back portion 51 is extended stepwise from the lower front portion 49 to receive the back surface of the insulator body 37 in cooperation with the upper back portion 47.

The lower front portion 49 comprises a lower front face portion. Two lower rectangular holes 49*a* are formed through the lower front face portion so as to snugly receive two of the flange projections 43*a*. Lower front side portions extend from the lower front face portion.

Inasmuch as the lower front portion 49 should tightly be received in the upper front portion 45, the lower front side portions should tightly fit inside the upper front side portions. Two front indents 49*b* are formed into each of the lower front side portions. The front indents 49*b* are for snugly receiving the front projections 45*b* projected from the upper front side portions.

The lower back portion 51 comprises a lower back face portion and a pair of lower back side portions. Two back indents 51*a* are formed into the lower back side portions. When put into place, the lower back side portions are brought into tight fit inside the upper back side portions with the back projections 47*a* of the upper back side portions snugly received in the back indents 51*a*.

The connector is connected to a cable (later illustrated). More specifically, the cable includes a plurality of conductive wires (later described). The conductive contacts 39 are connected to the conductive wires. A deformable ring 53 is extended backwardly from the lower back portion 51 of the lower back shell 35. After the conductive contacts 39 are connected to the conductive wires and the connector with shells is assembled, the cable is gripped by the deformable ring 53. An assembly of the connector with shells may be encased in an insulator hood which will later be illustrated.

The cable is connected to an electric appliance machine (not shown). Alternatively, the female connector is fixedly attached to the electric appliance machine. Various electric appliance machines are used in factories and offices and at home. Such an electric appliance machine often comprises a microprocessor. It is known in the art that the microprocessor is put into operation in synchronism with a clock signal of an appreciably high radio frequency. As a consequence, most of the electric appliance machines inevitably radiate electromagnetic energy. The electric appliance machines therefore give rise to electromagnetic interference (EMI) to other apparatus which are adjacent to the cables.

It is consequently usual that the cable is a shielded cable. The front shell 41 and the upper and the lower back shells 33 and 35 collectively serve to prevent the electromagnetic energy from being scattered to the other apparatus. Alternatively, the other apparatus scatters electromagnetic waves. For example, such an electromagnetic wave is emitted from a motor cycle. Such electromagnetic waves give rise to the electromagnetic interference to an electric appliance machine connected to the cable if the connector with shells is insufficiently capable of shutting the electromagnetic waves off.

In order to enable the connector with shells to more completely shut off the electromagnetic energy or waves, the first shell 41 and the upper and the lower back shells 33 and 35 are brought into best possible electric contact with one another. More particularly, each of the flange protrusions 43*a* is given a width which is a little wider than a mating one of the upper and the lower rectangular holes 45*a* and 49*a*. In this manner, the flange projections 43*a* are press-inserted into the upper and the lower rectangular holes 45*a* and 49*a*. This, however, complicates assembly of the connector with shells. Even with this, the electric contact may still be insufficient between the front shell 41 and the upper back shell 33 and between the front shell 41 and the lower back shell 45.

Referring to FIGS. 2 through 5, the description will proceed to a connector according to a first embodiment of this invention. Throughout the following, similar parts are designated by like reference numerals. The connector body 31 and the front shell 41 will first be described. The back shells 33 and 35 will later be described with reference to different drawing figures.

The cylindrical portion of the front shell 41 comprises a pair of parallel opposing walls or portions and a pair of semicylindrical walls between the opposing portions. The cylindrical portion has a rounded front edge in the manner which will presently be illustrated in vertical section. From the flange 43, the four flange projections 43*a* extend perpendicularly of the opposing walls.

In the insulator body 37, right and left upper and lower indents are formed into the upper and the lower side surfaces extending from the front surface backwardly along the connector axis rightwards and leftwards outwardly of the flange projections 43*a*. Nested in these indents, right and left upper and lower resilient conductive members or metal leaf springs 55 are extended backwardly from the flange 43 and slightly upwards and downwards in their free states away from the connector axis. The right or the left upper and lower resilient conductive members 55 are herein alternatively called first and second resilient conductive members. The right or the left upper and lower indents are similarly called first and second indents. It is possible to understand that such first and second resilient conductive members 55 are backwardly extended from the opposing walls of the front shell 41. The first and the second resilient conductive members 55 are spaced apart at their free ends by a first distance d(1).

In the example being illustrated, the insulator body 37 has upper and lower insulator projections 37*a* protruded from the upper and the lower surfaces centrally between the right and the left side surfaces. From the flange 43, upper or first and lower or second metal sheet extensions 57 are extended backwardly parallel to the connector axis. First and second rectangular holes are formed through the first and the second metal sheet extensions 57 to receive the insulator projections 37*a*. The sheet extensions 57 are adjacent to the upper and the lower side surfaces of the insulator body 37.

Figure 6:
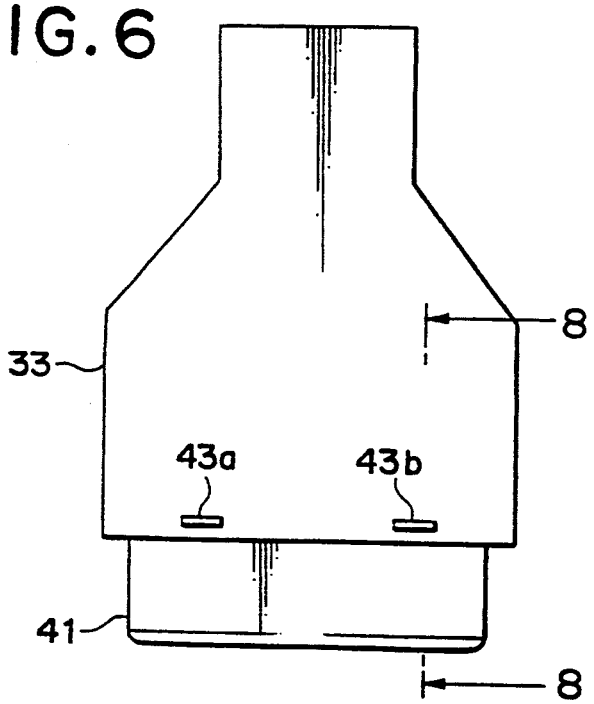
FIG. 6 is a schematic top view of a connector which is of the type illustrated in FIGS. 2 to 5 and is covered with a conductive housing.
Figure 7:
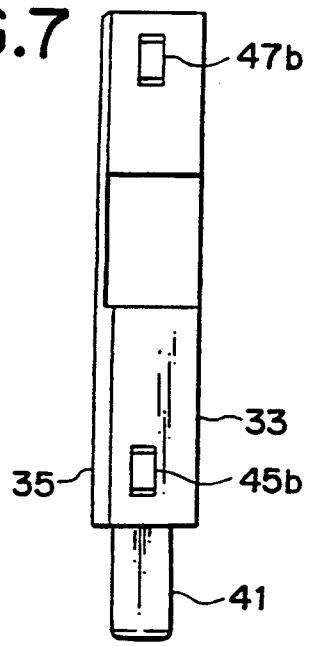
FIG. 7 is a schematic left side view of the connector depicted in FIG. 6.
Figure 8:
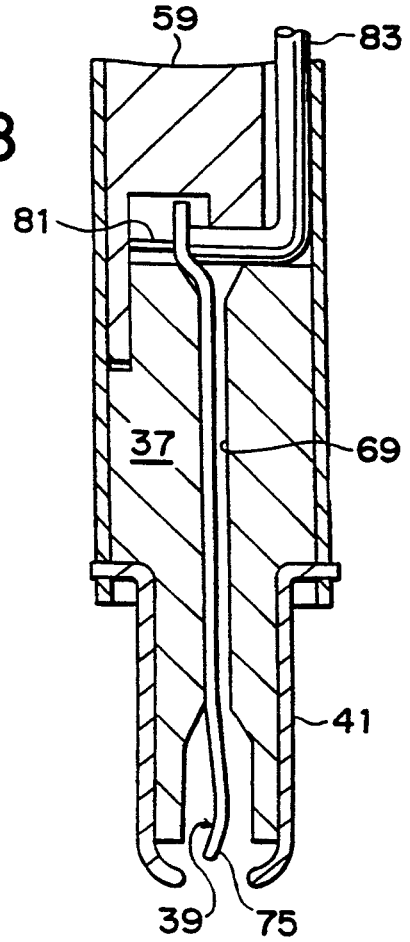
FIG. 8 is a schematic vertical sectional view of the connector shown in FIGS. 6 and 7, taken on a line 8—8 of FIG. 6.

Turning to FIGS. 6 through 8, the upper and the lower back shells 33 and 35 will be described. These shells 33 and 35 are alternatively referred to as first and second back shells. Like in the conventional connector illustrated with reference to FIG. 1, the upper and the lower front portions 45 and 49 (FIG. 1) cover the flange 43 and slightly partly the front shell 41. The upper and the lower front portions 45 and 49 and the back portions 47 and 51 (FIG. 1) are fixed to the insulator body 37 by cooperation of the flange projections 43*a* and the upper and the lower rectangular holes 45*a* and 49*a* (FIG. 1), of the insulator projections 37*a* and the first and the second rectangular holes, and of the front and the back projections 45*b* and 47*a* (FIG. 1) and the front and the back indents 49*b* and 51*a* (FIG. 1).

Referring more particularly to FIG. 8, the first and the second back shells 33 and 35 have first and second inside surfaces in mechanical contact with the upper and the lower side surfaces of the insulator body 37 and in electric contact, through the flange projections 43*a*, with the opposing portions of the front shell 41. The first and the second inside surfaces are spaced apart by a second distance d(2). The first distance d(1) should be greater than the second distance d(2) before the back shells 33 and 35 are fixed to the insulator body 37 and to the front shell 41.

It will now be presumed that the first and the second back shells 33 and 35 are fixed in place to the insulator body 37 and to the front shell 41. In the manner readily understood, the first and the second resilient conductive members 55 are similarly deformed in the first and the second indents into mechanical contact with the first and the second inside surfaces by cooperation of the back shells 33 and 35 and the insulator body 37. The first and the second resilient conductive members 55 thereby reinforce the electric contact between the opposing portions of the front shell 41 and the first and the second inside surfaces of the back shells 33 and 35. Incidentally, the back surface of the insulator body 37 is covered with an insulator cover 59, which will later be described in greater detail.

Figure 9:
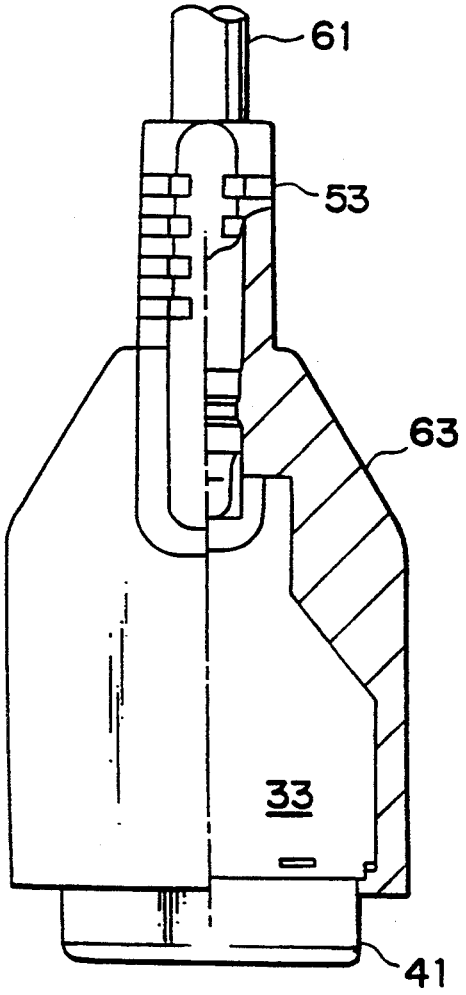
FIG. 9 is a schematic top view of a connector covered with an insulator hood, with most of a right half of the figure depicted in a horizontal section.
Figure 10:
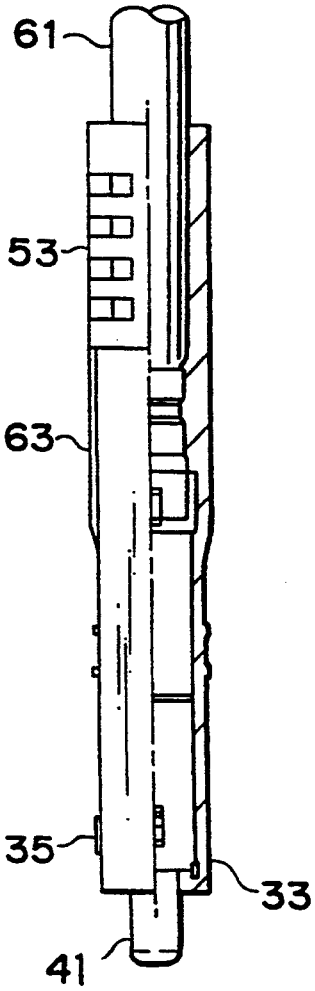
FIG. 10 is a schematic left side view of the connector depicted in FIG. 9 with a right half illustrated in a vertical section.

Turning further to FIGS. 9 and 10, the cable is depicted at 61 and is gripped by the deformable ring 53 described in conjunction with FIG. 1. The back shells 33 and 35 are covered with an insulator hood 63, which will shortly be described. The cable 61 is a shielded cable. The deformable ring 53 is brought into electric contact with a covering shield of the cable 61.

Figure 11:
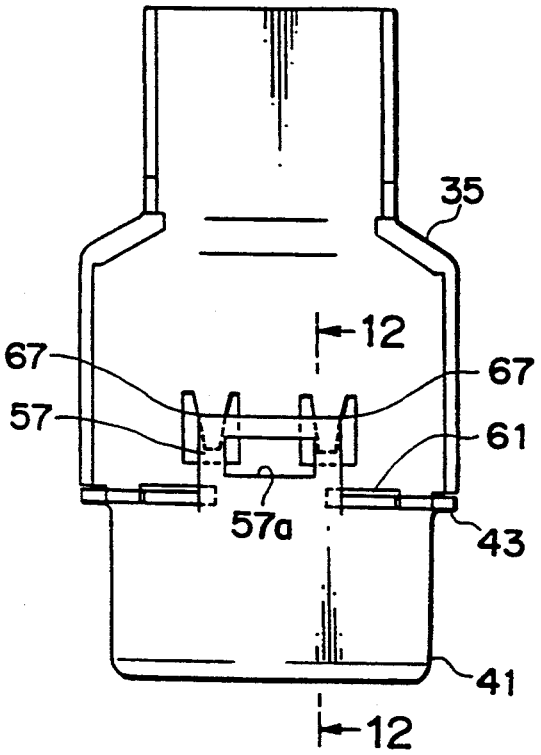
FIG. 11 is a schematic top view of a lower back shell used together with a front shell in a connector according to a modification of the connector shown in FIGS. 2 through 4.
Figure 12:
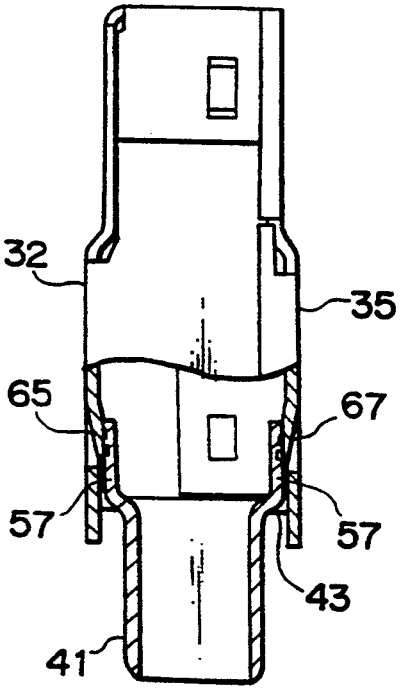
FIG. 12 is a schematic right side view of the front and the lower back shells depicted in FIG. 11 with a part illustrated in a vertical section taken on line 12—12 of FIG. 11.

Referring now to FIGS. 11 and 12, attention will be directed to a modification of the connector illustrated with reference to FIGS. 2 through 10. It is possible to use the connector of FIGS. 11 and 12 either singly or in combination with the connector described with reference to FIGS. 2 to 10. The first and the second resilient conductive members 55 (FIGS. 2 to 5) will now be called first and second front shell resilient conductive members.

In FIGS. 11 and 12, the first and the second metal sheet extensions 57 of the flange 43 or of the opposing portions of the front shell 41 are schematically depicted. One of the first and the second rectangular holes is illustrated at 57*a*.

The first back shell 33 comprises upper right and left back shell resilient conductive members 65 extended forwardly from the first inside surface and slightly inwardly towards the second back shell 35. Similarly, the second back shell 35 comprises lower right and left back shell resilient conductive members 67. In the manner depicted in FIG. 11, the lower right and left back shell resilient conductive members 67 should be positioned so as to be in mechanical and electric contact with the second metal sheet extension 57. This applies to the upper right and left back shell resilient conductive members 65.

The upper and the lower right or left back shell resilient conductive members 65 and 67 will be called first and second back shell resilient conductive members. Such first and second back shell resilient conductive members 65 and 67 are spaced apart at their free ends by a third distance. The first and the second metal sheet extensions have outer surfaces spaced apart by a fourth distance. Before the first and the second back shells 33 and 35 are fixed in place to the insulator body 37 and to the front shell 41, the third distance should be less than the fourth distance.

It will again be presumed that the first and the second back shells 33 and 35 are fixed in place. With the first and the second metal sheet extensions 57 and the first and the second back shell resilient conductive members 65 and 67 interposed, the first and the second inside surfaces of the first and the second back shells 33 and 35 are pressed against the upper and the lower side surfaces of the insulator body 37. In this manner, the first and the second back shell resilient conductive members 65 and 67 are resiliently deformed into mechanical contact with the first and the second metal sheet extensions 57 and consequently with the opposing portions of the front shell 41. The back shell resilient conductive members 65 and 67 thereby reinforce the electric contact between the opposing portions of the front shell 41 and the first and the second inside surfaces of the back shells 33 and 35.

Figure 13:
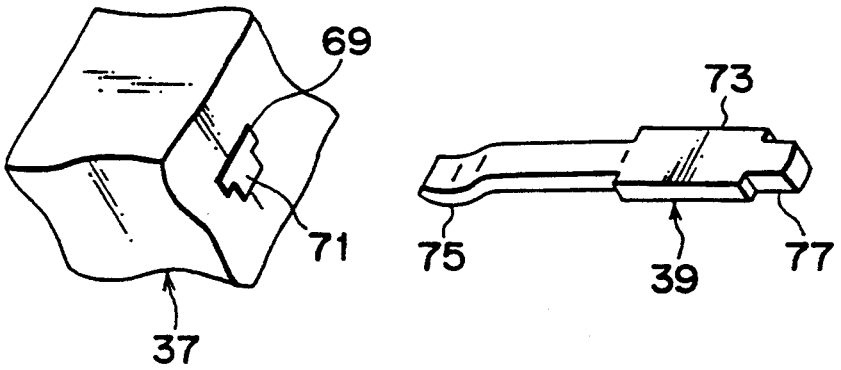
FIG. 13 PRIOR ART
FIG. 13 is an exploded schematic partial perspective view of another conventional connector.

Referring to FIG. 13, each of the conductive contacts 39 is firmly held by the insulator body 37 as follows in a conventional connector. In the manner described before, the insulator body 37 has the connector axis. The insulator body 37 has a front and a back surface perpendicular to the connector axis.

A plurality of holding holes 69 are formed through the insulator body 37 to open at the front and the back surfaces. Each of the holding holes 69 is rectangular in cross-section. For the purpose which will presently be described, a guide way 71 is extended from each of the holding holes 69 perpendicularly of the connector axis in a predetermined direction, such as top to bottom and in a predetermined one of senses of the direction, such as downwardly. The holding holes 69 are parallel to the connector axis and in one-to-one correspondence to the conductive contacts 39.

Each of the conductive contacts 39 comprises a contact stem or body 73 having a planar surface and a width which is for force fit in a corresponding one of the holding holes 69. A contact end 75 is extended from the contact stem 73 and is curved relative to or from the planar surface of the contact stem 73. The guide way 71 is for allowing passage therethrough of the contact end 75 when the conductive contacts 39 are forced into the holding holes 69 from the back surface of the insulator body 37 so that the contact ends 75 may protrude resiliently from the front surface. A contact leg 77 is extended from the contact stem 73 opposite to the contact end 75 and has a narrower width than the contact stem 73. The conductive wires (later illustrated) are connected to such contact legs 77.

In a conventional connector of the type described, the guide ways 71 are left open to surroundings of the insulator body 37 when the conductive contacts 39 are firmly held by the insulator body 37. In the manner which is described heretobefore and will later be described, the conductive housing is covered in general with the hood 63 of an insulating material. On molding the connector with the conductive housing in the insulator material, the insulator material unavoidably flows into the guide ways 71. In order to prevent the insulator material from flowing into the guide ways 71, potting has conventionally been applied to fill the guide ways 71 with resin. Potting is, however, troublesome, raises the cost of manufacture of such connectors, and gives rise to fluctuations in qualities of the connectors.

Figure 14:
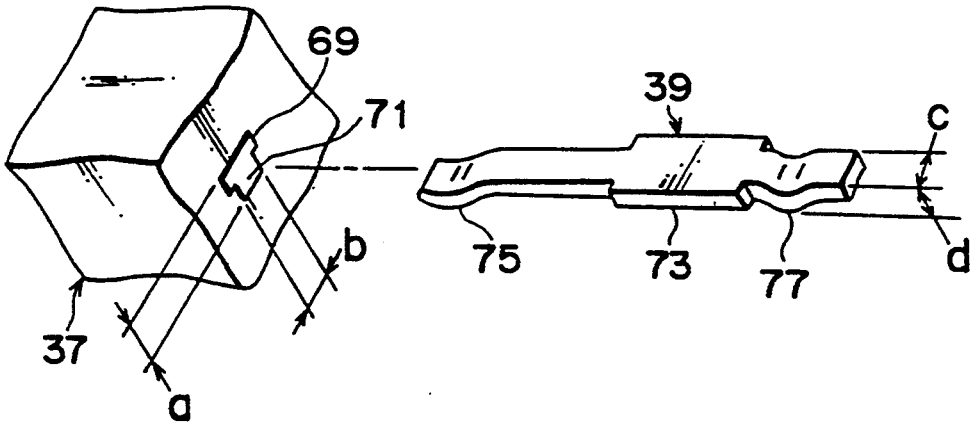
FIG. 14 is an exploded schematic partial perspective view of a connector according to a second embodiment of this invention.

Referring now afresh to FIG. 14, the description will proceed to a connector according to a second embodiment of this invention. This connector is of the type illustrated with reference either to FIGS. 2 through 10 or to FIGS. 11 and 12. Alternatively, this connector may be a more general connector which is not covered with the conductive housing.

In the manner described in connection with FIG. 13, the insulator body 37 has a connector axis and a front and a back surface perpendicular to the connector axis. A plurality of holding holes 69 are formed through the insulator body 37 parallel to the connector axis and in one-to-one correspondence to the conductive contacts 39. A guide way 71 is extended like in FIG. 13. The holding holes 69 and such guide ways 71 are open at the front and the back surfaces of the insulator body 37. Each holding hole 69 is rectangular in cross-section. A combination of each holding hole 69 and the guide way 71 has a height a. The guide way 71 has a width b.

Each of the conductive contacts 39 is given a shape which is similar in general to that described in connection with FIG. 13. It should, however, be noted that the contact leg 77 is curved relative to or from the planar surface of the contact stem 73. The contact end 75 has a width which is narrower than the width b. The contact end 75 is curved relative to the planar surface to have an overall height which is less than the height a. The contact leg 77 has a width c which closely fits the width b. Curved in the manner depicted, the contact stem 77 has an overall height d which closely fits the height a.

When the conductive contact 39 is forced from the back surface of the insulator body 37 into a corresponding one of the holding holes 69 with the guide way 71, the contact stem 73 is brought into force fit in the holding hole 69. The contact leg 77 fills the guide way 71. The conductive contacts 39 therefore completely shut the holding holes 69 with the guide ways 71. This makes it unnecessary to resort to potting which has otherwise been inevitable.

Figure 15:
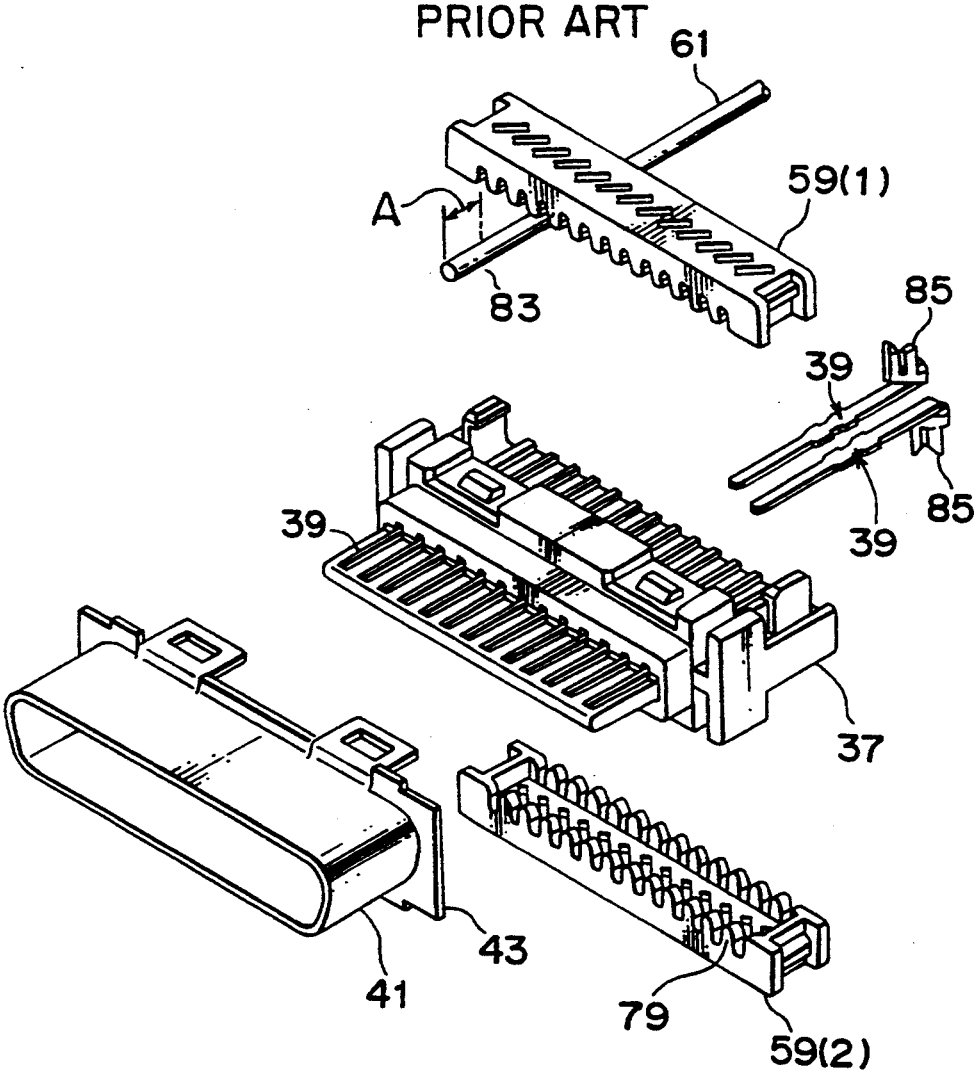
FIG. 15 PRIOR ART
FIG. 15 is an exploded schematic perspective view of still another conventional connector.
Figure 16:
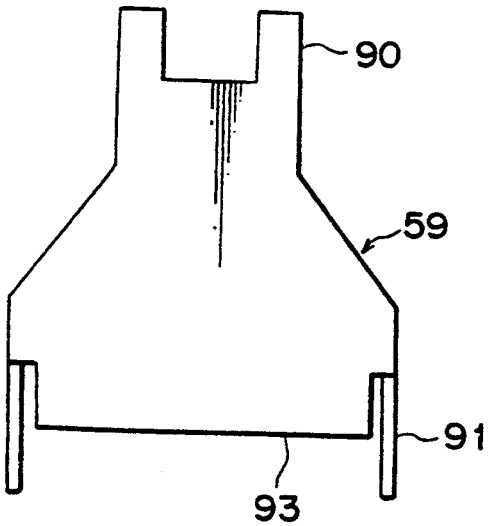
FIG. 16 is a schematic top view of an insulator cover for use in a connector according to a third embodiment of this invention.
Figure 19:
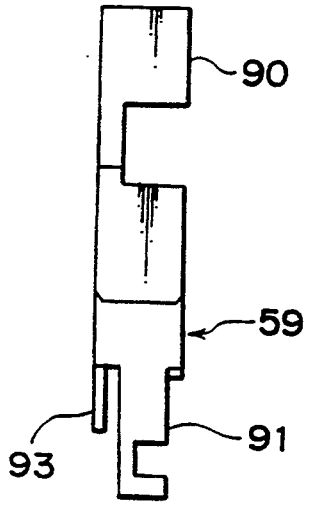
FIG. 19 is a schematic right side view of the cover illustrated in FIG. 16.
Figure 17:
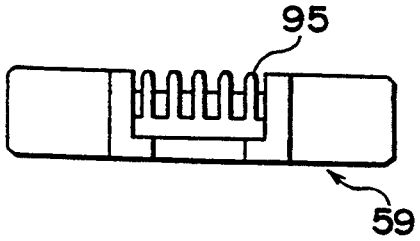
FIG. 17 is a schematic back view of the cover depicted in FIG. 16.
Figure 18:
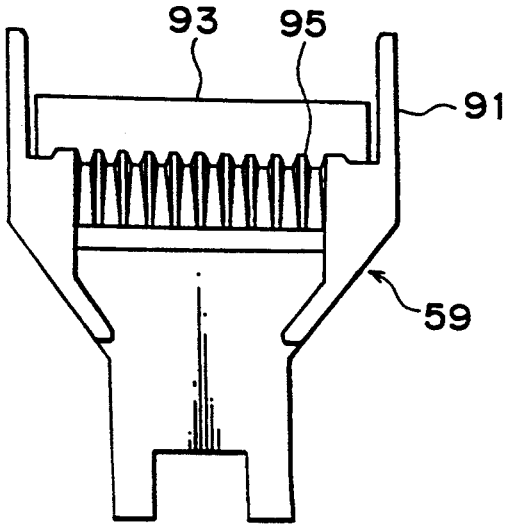
FIG. 18 is a schematic bottom view of the cover shown in FIG. 16.
Figure 20:
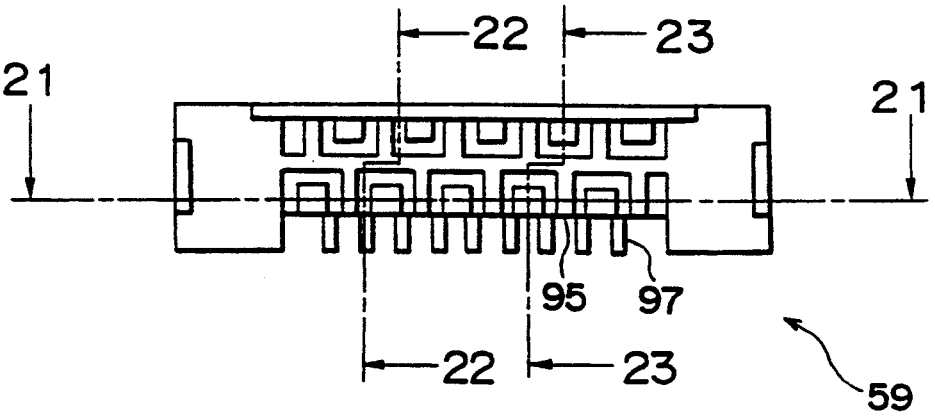
FIG. 20 is an enlarged schematic front view of the cover depicted in FIG. 16.
Figure 21:
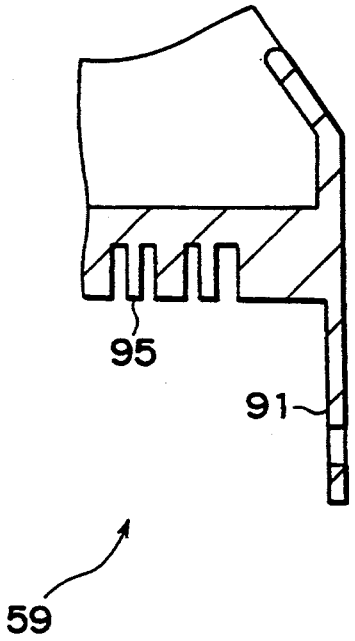
FIG. 21 is a partial schematic horizontal view of the cover taken on line 21—21 in FIG. 20.
Figure 22:
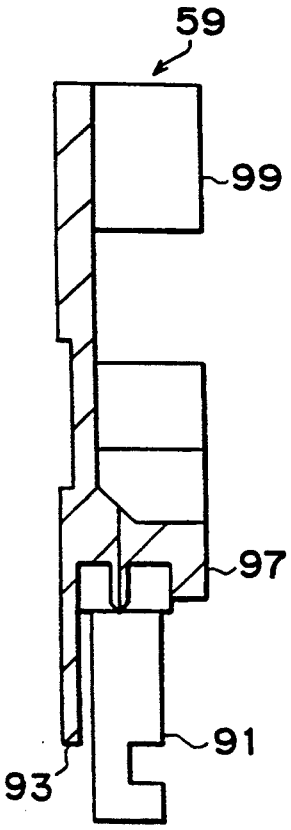
FIG. 22 is a schematic vertical sectional view of the cover taken on line 22—22 in FIG. 20.
Figure 23:
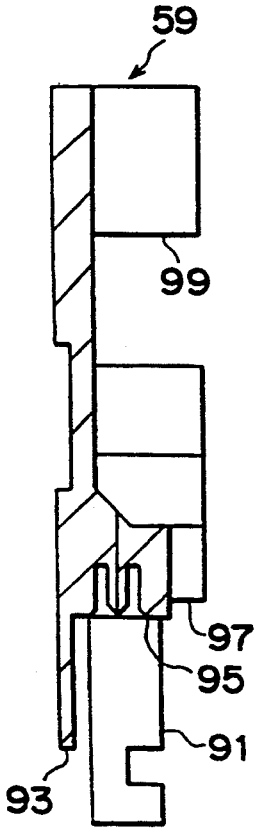
FIG. 23 is a schematic vertical sectional view of the cover taken on line 23—23 in FIG. 20.

Referring to FIG. 15, another conventional connector will be described. Although the conductive housing is not depicted in FIG. 15, it will be surmised that the connector body 31 is covered with the conductive housing in the manner described in conjunction with FIGS. 2 through 12. The insulator piece 59 will now be described in detail in the following.

As described, the front shell 41 is attached to the insulator body 37 to cover its front surface in cooperation with the metal flange 43 and protects the conductive contacts 39 which are firmly held in the insulator body 37 and projected forwardly from the front surface. The insulator piece 59 comprises first and second insulator components 59(1) and 59(2) and has projections 79 to hold conductive wires 81 of the cable 61 in one-to-one correspondence to the conductive contacts 39. Each conductive wire 81 is covered with an insulator cover 83.

Like in FIG. 13 or 14, each of the conductive contacts 39 comprises a contact stem 73 and a contact end 75. Instead of the contact leg 77 described in connection with FIG. 13 or 14, the conductive contact 39 comprises a bifurcated conductive end 85 extended from the contact stem 73 opposite to the contact end 75. For use in the conventional connector, the bifurcated conductive end 85 is perpendicular to the planar surface of the contact stem 73 and directed sideways.

On assembling the connector, the insulator covers 83 of the cable 61 are first forcibly inserted between the projections 79 of the insulator piece 59. Next, the insulator piece 59 is pushed against the back surface of the insulator body 37. The conductive wires 81 are brought into electric contact with the bifurcated conductive ends 85. Clad in each insulator cover 83, the conductive wire 81 extends parallel to the connector axis.

As a consequence, the conductive wires 81 are liable to slip backwards from the insulator body 37 to harm the electric contact. Each conductive wire 81 is forwardly extended from the insulator piece 59 by a length A which is longer than necessary. The conductive housing may undesiredly be brought into electric contact with the conductive wire or wires 81. It has been the practice to interpose an insulator sheet (not shown) between the conductive wires 81 and the conductive housing. The connector has a thickness which is objectionably thick.

Referring now to FIGS. 16 through 19, the insulator piece 59 is intended primarily for use in a connector according to a third embodiment of this invention. The connector will be described with additional reference to FIG. 8 among other drawing figures.

In the manner described in conjunction with FIG. 13 or 14, the insulator body 37 has a connector axis and a front and a back surface. A plurality of holding holes 69 are formed through the insulator body 37 parallel to the connector axis to open at the front surface and in one-to-one correspondence to the conductive contacts 39. The insulator body 37 is given a recessed surface 87 best depicted in FIG. 5. Although similarly named, guide holes are extended backwardly from the holding holes 69 to open at the back surface and at the recessed surface 87 and to have bottom walls contiguous to the holding holes 69.

As before, each of the conductive contacts 39 comprises the contact stem 73 for force fit in a corresponding one of the holding holes 69. The contact end 75 is extended from the contact stem 73. The bifurcated conductive end 85 is extended from the contact stem 73 opposite to the contact end 75. In contrast to the bifurcated conductive end 85 used in the conventional connector illustrated with reference to FIG. 15, the bifurcated conductive end 85 is extended parallel to the planar surface of the contact stem 73.

In the example being illustrated, the bifurcated conductive end 85 is slightly bent from the contact stem 73. Such bifurcated conductive ends 85 are situated in the guide holes along two parallel horizontal planes in a staggered manner. It should be noted in this connection that the conductive contacts 39 are forced into the insulator body 37 from the back surface with each contact stem 73 brought into force fit in a corresponding one of the holding holes 69 and with each contact end 75 forwardly and resiliently protruded from the front surface.

Clothing the conductive wires 81 respectively, the insulator covers 83 of the cable 61 are in one-to-one correspondence to the conductive contacts 39. The insulator covers 83 are pressed towards the bottom walls of the guide holes. Each conductive wire 81 is brought into press fit in the bifurcated conductive end 85 of a corresponding one of the conductive contacts 39. The conductive wires 81 are cut along the recessed surface 87 if extended outwardly beyond the recessed surface 87. It is possible to use jigs on bringing the conductive wires 81 into the press fit and on cutting the conductive wires 81.

Different from the conductive wires 81 used in the conventional connector, the conductive wires 81 with the insulator covers 83 are extended substantially perpendicular to the connector axis. This gives a salient feature to the illustrated connector in the manner which will presently be described.

Turning to FIGS. 20 through 23 with FIGS. 8 and 16 through 19 continuously referred to, the insulator piece 59 is somewhat complicated in shape. It is, however, readily possible to design and manufacture the insulator piece 59 either as an integral body or as two separate bodies as best exemplified in FIGS. 22 and 23.

More particularly, the insulator piece 59 has a front face and a lower or front and an upper or back side face. Right and left forward extensions 91 are extended forwardly from the front face. The insulator body 37 is shaped accordingly to receive the right and the left forward extensions 91 along its right and left side surfaces. An insulator extension 93 is forwardly extended from the front face along the upper side face between the right and the left forward extensions 91.

A plurality of projection hands 95 are extended perpendicularly from a projection plate or body to reach the upper side face and towards the lower side face. A plurality of insulator projections are formed, each between two adjacent ones of the projection hands 95. Deep holes are formed by the projection hands 95 and the insulator projections in correspondence to the bifurcated conductive ends 85 situated in the guide holes 89.

Backward projections 97 are protruded away from the upper side face to reach the lower side face in correspondence to the deep holes. Right and left backward extensions 99 are extended backwardly so as to be brought into mechanical contact with the back side portions of the upper and the lower back shells 49 and 51.

The insulator piece 59 is urged to the back surface of the insulator body 37. The insulator extension 93 is brought into mechanical contact with the recessed surface 87. The right and the left forward extensions 91 are received by the insulator body 37 along the right and the left side surfaces. The projection hands 95 are received in the guide holes 89. The insulator covers 83 with the conductive wires 81 are received between the backward projections 97. The cable 61 is placed between the backward extensions 99.

Urged to the back surface of the insulator body 37, the insulator piece 59 completely shuts the guide holes 89. The insulator extension 93 insures electric insulation between the conductive wires 81 and the back shell 33 without objectionably increasing the thickness of the connector. By the projection hands 95, the insulator covers 83 are pressed towards the bottom walls of the guide holes 89. This reliably prevents the conductive wires 81 from slipping away from the insulator body 37.

The insulator hood 63 (FIG. 9) is molded onto the conductive housing. Inasmuch as the guide holes 89 are shut by the insulator piece 59, it is necessary neither to curve each contact leg 77 in the manner described in conjunction with FIG. 14 nor to resort to the potting described in connection with FIG. 13.

While this invention has thus far been described in specific conjunction with a few preferred embodiments thereof, it will now be readily possible for one skilled in the art to put this invention into effect in various other manners. For example, only one resilient conductive member may be extended either forwardly from the front shell 41 or backwardly from a predetermined one of the back shells 33 and 35. It is possible to implement a connector in accordance either with FIGS. 2 to 10 or FIGS. 11 and 12. A connector may be implemented according to FIG. 14 or to FIGS. 16 through 23. Alternatively, the connector may be manufactured according to FIGS. 1 to 10 and FIGS. 11 and 12. In addition, it is possible to make the connector have the structure illustrated with reference to FIG. 14 or to FIGS. 16 through 23.

What is claimed is:

1. A connector covered with a conductive housing and comprising an insulator body and a plurality of conductive contacts extended forwardly from said insulator body, said conductive housing comprising a front shell having a pair of opposing portions and protecting said conductive contacts and first and second back shells put in electric contact with each other and having first and second inside surfaces in mechanical contact with said insulator body and in electric contact with said opposing portions, wherein said front shell comprises a resilient conductive member backwardly extended from a predetermined one of said opposing portions and resiliently deformed into mechanical contact with one of said first and said second inside surfaces that is in electric contact with said predetermined one of the opposing portions, said resilient conductive member reinforcing the electric contact between said predetermined one of the opposing portions and said one of the first and the second inside surfaces, said insulator body having a connector axis, main walls defining a plurality of holding holes parallel to said connector axis in a one-to-one correspondence to said conductive contacts, and a wall extension extended from each of said main walls to define a guide way, each of said conductive contacts comprising a contact stem having a planar surface and for force fit in a corresponding one of said holding holes, a contact end extended from said contact stem and curved relative to said planar surface to pass through said guide way, and a contact leg extended from said contact stem opposite to said contact end, wherein said contact stem is curved relative to said planar surface to fill said guide way when said contact stem is brought in force fit in the corresponding one of said holding holes with said contact end protruded forwardly from said insulator body.

2. A connector covered with a conductive housing and comprising an insulator body and a plurality of conductive contacts extended forwardly from said insulator body, said conductive housing comprising a front shell having a pair of opposing portions and protecting said conductive contacts and first and second back shells put in electric contact with each other and having first and second inside surfaces in mechanical contact with said insulator body and in electric contact with said opposing portions, wherein said front shell comprises a resilient conductive member backwardly extended from a predetermined one of said opposing portions and resiliently deformed into mechanical contact with one of said first and said second inside surfaces that is in electric contact with said predetermined one of the opposing portions, said resilient conductive member reinforcing the electric contact between said predetermined one of the opposing portions and said one of the first and the second inside surfaces, said resilient conductive member being a front shell resilient conductive member, wherein a predetermined one of said first and said second back shells comprises a back shell resilient conductive member forwardly extended from one of said first and said second inside surfaces that said predetermined one of the first and the second back shells has, said back shell resilient conductive member being resiliently deformed into mechanical contact with said opposing portions to reinforce the electric contact between said opposing portions and said one of the first and the second inside surfaces, said insulator body having a connector axis, main walls defining a plurality of holding holes parallel to said connector axis in one-to-one correspondence to said conductive contacts, and a wall extension extended from each of said main walls to define a guide way, each of said conductive contacts comprising a contact stem having a planar surface and for force fit in a corresponding one of said holding holes, a contact end extended from said contact stem and curved relative to said planar surface to pass through said guide way, and a contact leg extended from said contact stem opposite to said contact end, wherein said contact leg is curved relative to said planar surface to fill said guide way when said contact stem is brought into force fit in the corresponding one of said holding holes with said contact end protruded forwardly from said insulator body.

3. A connector comprising an insulator body having a connector axis and a plurality of conductive contacts extended parallel to said connector axis and forwardly from said insulator body, said insulator body having main walls defining a plurality of holding holes parallel to said connector axis and in one-to-one correspondence to said conductive contacts, and a wall extension extended from each of said main walls to define a guide way, each of said conductive contacts comprising a contact stem having a planar surface and for force fit to a corresponding one of said holding holes, a contact end extended from said contact stem and curved relative to said planar surface to pass through said guide way, and a contact leg extended from said contact stem opposite to said contact end, wherein said contact leg is curved relative to said planar surface to fill said guide way when said contact stem is brought in force fit to the corresponding one of said holding holes with said contact end protruded forwardly from said insulator body.

* * * * *